United States Patent [19]

Sluyterman

[11] Patent Number: 4,962,333

[45] Date of Patent: Oct. 9, 1990

[54] COMA-CORRECTED PICTURE DISPLAY SYSTEM

[75] Inventor: Albertus A. S. Sluyterman, Eindhoven, Netherlands

[73] Assignee: U.S. Philips Corporation, New York, N.Y.

[21] Appl. No.: 309,464

[22] Filed: Feb. 10, 1989

[30] Foreign Application Priority Data

Sep. 6, 1988 [NL] Netherlands ..... 8802194

[51] Int. Cl.[5] ..... H01J 29/70

[52] U.S. Cl. ..... 313/440; 313/413

[58] Field of Search ..... 313/440, 414, 412, 413, 313/431

[56] References Cited

U.S. PATENT DOCUMENTS 4,415,831 11/1983 Konosu ..... 313/431 X 4,600,858 7/1986 Iwasaki et al. ..... 313/413

4,625,145 11/1986 Gerritsen et al. ..... 313/413

FOREIGN PATENT DOCUMENTS 56-167242 12/1981 Japan .

*Primary Examiner*—Sandra L. O'Shea

[57] ABSTRACT

A color television display tube comprising a system of three co-planar electron guns and an electro-magnetic deflection unit comprising a field deflection coil and a line deflection coil. For correcting certain convergence errors a pair of axially extending pole shoes of a magnetizable material is arranged in a plane symmetrically with respect to the tube axis between the deflection unit and the gun system, which pole shoes are magnetically coupled to each other, for example by means of a ring of a magnetizable material.

4 Claims, 3 Drawing Sheets

COMA-CORRECTED PICTURE DISPLAY SYSTEM

The invention relates to a picture display system comprising a colour television display tube having a neck accommodating an electron gun assembly for generating three co-planar electron beams, and an electromagnetic deflection unit surrounding the paths of the electron beams which have left the electron gun assembly, said deflection unit comprising:

a line deflection coil of the saddle type having a front and rear end for deflecting electron beams generated in the display tube in a horizontal direction; a yoke ring of a ferro-magnetic material surrounding the line deflection coil and having front and rear end faces extending transversely to the tube axis, and a field deflection coil comprising two diametrically arranged halves and also having a front and rear end for deflecting electron beams generated in the display tube in a vertical direction, the electron beams generated by the electron gun assembly traversing the deflection coils in the direction from the rear ends to the front ends. Deflecton units of the type described above may comprise a field deflection coil of the saddle type or a field deflection coil of the type toroidally wound on the yoke ring. In the latter case the deflection units are said to be of the hybrid type.

For some time a colour television display tube has come into fashion in which three electron beams in one plane are used, which type of cathode ray tube is referred to as "in-line". For reducing convergence errors of the electron beams a deflection unit is used which comprises a line deflection coil generating a horizontal deflection field of the pincushion-shaped type and a field deflection coil generating a vertical deflection field of the barrel-shaped type.

Deflection units for in-line colour television display tube systems can be made fully self-convergent by using the Haantjes and Lubben principle, which means that possible convergence errors in the corners can be rendered zero in a deflection unit design ensuring convergence of the three electron beams on the axes.

To correct possibly remaining convergence errors of the field coma type, frequent use is made in practice of correction means comprising rings of magnetically conducting material arranged at the end of the electron gun assembly around the paths of the outer electron beams, which rings shield the outer beams to a certain extent against the influence of the deflection fields (so-called"-field shapers"). A drawback of the use of this type of correction means is that the spots of the outer beams exhibit a certain extent of vagueness so that picture display systems using these means cannot comply with the stringent requirements of spot definition.

It is an object of the invention to provide a picture display system of the type described in the opening paragraph which comprises a coma correction means providing the possibility of an improved spot definition.

To this end a picture display system according to the invention is characterized in that a first pair of axially extending pole shoes of a magnetizable material is arranged in the said plane symmetrically with respect to the tube axis at the rear end of the deflection unit, substantially between the rear end and the electron gun assembly, which pole shoes are magnetically coupled to each other.

The invention is based on the recognition that the two pole shoes which are arranged in the verical deflection field in the manner described above and which are magnetically coupled to each other and thus have the same magnetic potential in operation, remove deflection field (so that the deflection becomes less), with more field being removed for the outer beams than for the central beam. This enables coma to be corrected with fewer side effects than when using the conventional coma correction means.

To couple the pole shoes magnetically to each other, they are connected, in an embodiment according to the invention, at their gunsided ends by means of an annular element of a magnetically conducting material surrounding the paths of the electron beams. Moreover, this annular element facilitates their assembly. The pole shoes may be arranged both within and outside (the neck portion of) the display tube and they may have a shape in conformity with the shape of the tube wall.

If the pole shoes are arranged within the display tube, the annular element may be advantageously used to secure the pole shoes. to the centring cup of the electron gun assembly, for example to its bottom. The coma-correcting effect of the pole shoes is dependent on the strength of the vertical deflection field in the region of these shoes. The strength of the vertical deflection field in the relevant region, which is mainly present between the field deflection coil and the electron gun assembly, is dependent on the design of the deflection unit.

In those cases where the vertical deflection field is too weak for this purpose in the region of the pole shoes, the invention provides a solution which is characterized in that magnetically permeable means are added to the deflection unit, which means have an orientation and position for extending the vertical deflection field towards the electron gun.

A very suitable embodiment is characterized in that the deflection unit comprises at its rear end second and third pairs of axially extending pole shoes which are oriented in accordance with the vertical deflection direction and which are arranged on the vertices of a square, the centre of the square being located on the tube axis and one pair of facing sides of the square being parallel to the vertical deflection direction, the second pair of pole shoes being magnetically coupled to a first side of the yoke ring and the third pair of pole shoes being magnetically coupled to the opposite side of the yoke ring, which sides have opposite magnetic potentials in operation, the one pole shoe of the first pair being present between the pole shoes of the second pair and the other pole shoe being present between the pole shoes of the third pair.

Deflection field is added by means of the second and third pairs of pole shoes (so that extra deflection is created, with the central beam being deflected more than the outer beams). This field has a dipole component and a six-pole component with the same sign as the dipole component. The pole shoes of the first pair remove deflection field (so that the deflection becomes less), with more field being removed for the outer beams than the central beam. Expressed in multipoles, this means that the first pole shoes ensure a six-pole field component with a dipole field component having the opposite sign. The configuration of pole shoes can be dimensioned in such a way that the outer beams are discriminated without extra deflection being created. In other words, a relatively pure six-pole field component is left which ensures that the green raster (of the central beam) remains, whereas the positions of the red and the blue raster (of the outer beams) are corrected.

Some embodiments of the invention will now be described in greater detail with reference to the accompanying drawings in which FIG. 1 is a diagrammatic side view of a colour television display tube comprising a deflection unit according to the invention;

Figure 8:
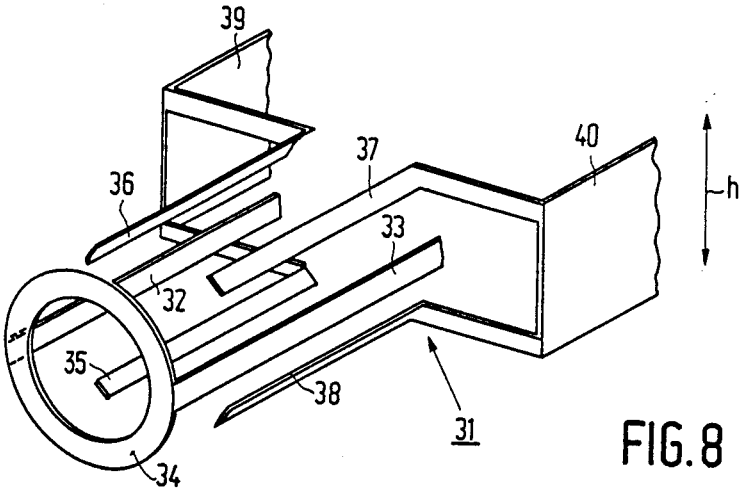
FIG. 8 is a combination of means extending the vertical deflection field and coma correction means according to the invention.
Figures 9A, 9B, 9C:
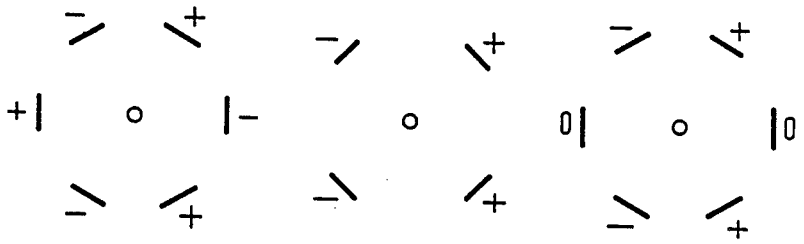
Figure 10:
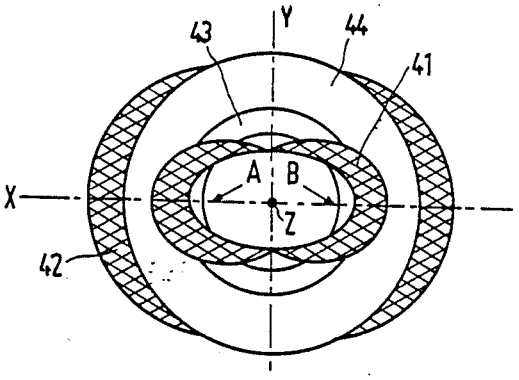

FIG. 9A is a cross-sectional view of FIG. 8, depicting the magnetic polarities of the pairs of pole shoes 32, 34 and 35, 36 and 37, 38, where the pair 32, 34 have opposite magnetic polarities;

FIG. 9B is a cross-sectional view of FIG. 8, depicting only the pairs of pole shoes 35, 36 and 37, 38 and the corresponding magnetic polarities;

FIG. 9C is also a cross-sectional view of FIG. 8, similar to FIG. 9, but here the pair 32, 34 have the same magnetic potentials; and FIG. 10 is a rear view of a yoke ring with a saddle-shaped field deflection coil suitable for use in a deflection unit in a device according to the invention.

Figure 1:
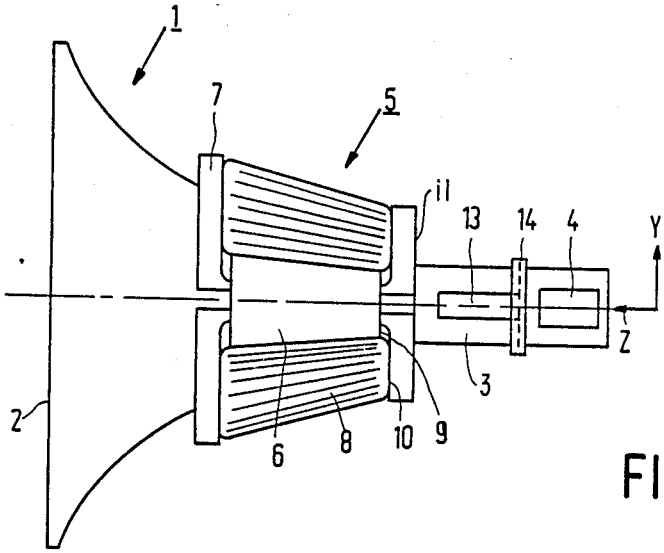

FIG. 1 is a diagrammatic elevational view of a vertical cross-section through a colour television display tube 1 of the "in-line" type comnprising a display screen 2, a tube neck 3 and three coplanar electron guns 4. A deflection unit 5 secured to the display tube comprises a yoke ring 6, a saddle coil 7 for the horizontal deflection (the so-called line deflection coil) and a toroidal coil 8 for the vertical deflection (the so-called field deflection coil).

The yoke ring 6 has a gun-sided end 9, the field deflection coil 8 has a gun-sided end 10 and the line deflection coil 7 has a flange-shaped gun-sided end 11 in this case.

Figure 2:
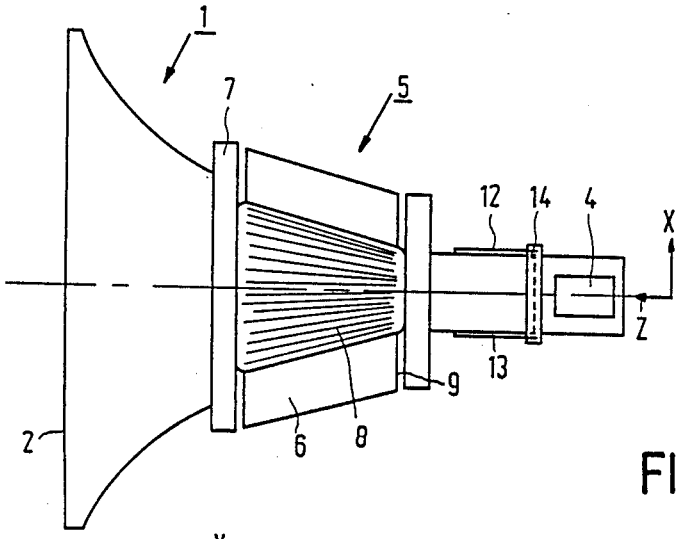
FIG. 2 is a diagrammatic plan view of the colour television display tube of FIG. 1.

Furthermore, the display tube 1 carries a pair of magnetically permeable pole shoes 12 and 13 (see also FIG. 2) which are symmetrically arranged with respect to the axis of the tube in the plane of the electron guns 4 (the x-z plane). The magnetically permeable pole shoes are magnetically coupled to each other, in this case by means of a ring 14 of a magnetically permeable material. The combination of pole shoes 12, 13 and ring 14, which combination serves as a coma correction means, is shown separately in FIG. 3. This combination is arranged on the outer side of the neck 3 of the display tube 1 in the situation shown in FIGS. 2 and 3, but it may be alternatively arranged within the neck 3 of the display tube 1. In the latter case the combination, as shown in FIG. 4 can be mounted in a practical manner by securing the ring to the bottom 50 of the centring cup 51 of the electron gun 4. The vertical deflection field is influenced by the combination of FIG. 3: vertical deflection field is removed (so that the deflection becomes less), with more field being removed for the outer electron beams than for the central beam. The effectiveness of this means is dependent on the strength of the vertical deflection field at the area where they are present. If necessary the vertical deflection field can be "extended" by using means as shown, for example in FIGS. 5, 6 and 7.

Figure 5:
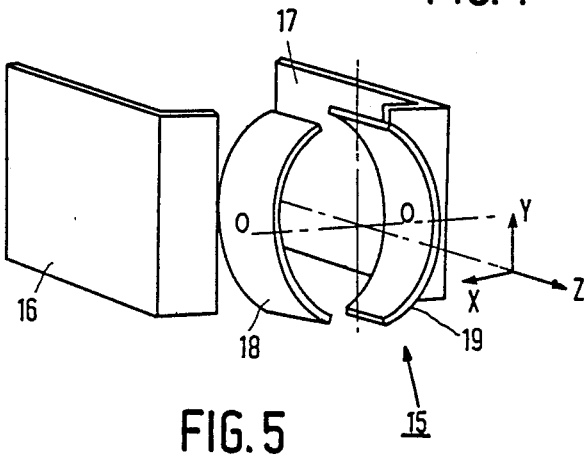
FIG. 5 is a perspective elevational view of a first embodiment of magnetically permeable means for extending the vertical deflection field.

FIG. 5 shows a field distribution means 15 which has two legs 16, 17 of a magnetically permeable material with which magnetic flux can be picked up from the yoke ring 6. To this end the legs 16, 17 may be arranged, for example along the sides of the yoke ring 6. Two bent elements 18, 19 of a magnetically permeable material are arranged symmetrically with respect to the y-z plane at the gun-sided ends of the legs 16, 17.

Figure 6:
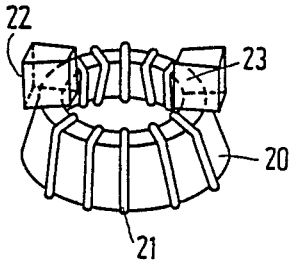
FIG. 6 is a perspective elevational view of a second embodiment of magnetically permeable means for extending the vertical deflection field.

FIG. 6 shows a yoke ring 20 intended for a deflection unit, on which ring a field deflection coil 21 is toroidally wound. Blocks 22, 23 of a magnetically permeable material are arranged at the gun-sided (narrow) end of the yoke ring 20.

Figure 7:
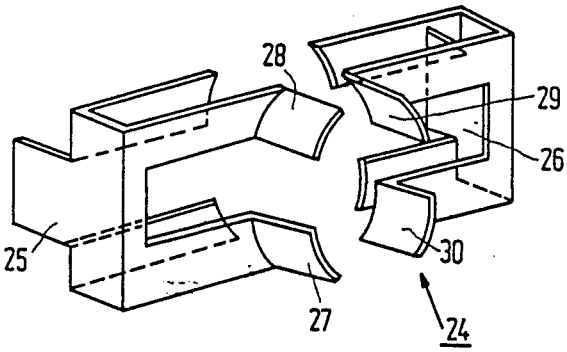
FIG. 7 is a perspective elevational view of a third embodiment of magnetically permeable means for extending the vertical deflection field.

FIG. 7 shows a device 24 having two legs 25, 26 of a magnetically permeable material for picking up magnetic flux from the yoke ring 6 in a way camparable to that described and reference to FIG. 5. The picked-up magnetic flux is redistributed by means of four pole shoes 27, 28, 30 to a position which is located further towards the gun system.

Figure 3:
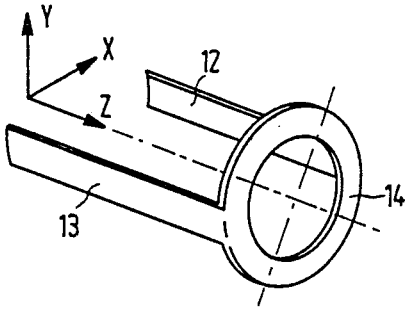
FIG. 3 is a perspective elevational view of the coma correction means used in the display tube of FIGS. 1 and 2.
Figure 4:
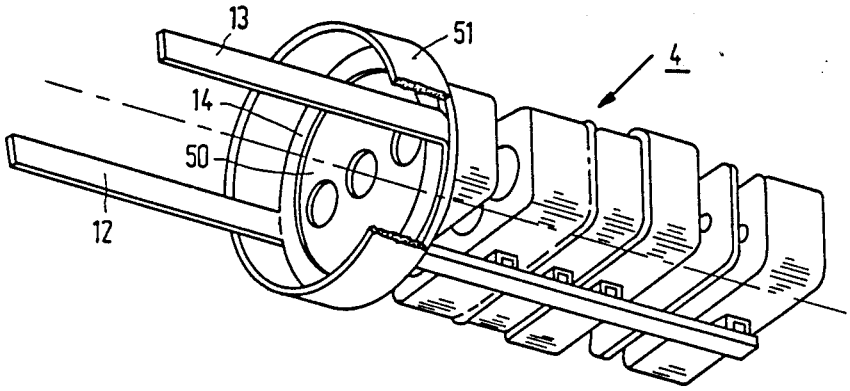
FIG. 4 is a perspective elevational view of an electron gun system comprising a coma correction means of the type shown in FIG. 3.

FIG. 8 shows a combination of a device of the type of FIG. 7 with a coma correction means of the type of FIG. 3. This combination 31 has first pole shoes 32, 33 which are magnetically coupled to each other by means of a ring 34 of a magnetically permeable material, and second pole shoes 35, 36 which are connected to a magnetically permeable flux pick-up leg 39 and third pole shoes 37, 38 which are connected to a magnetically permeable leg 40.

The following is achieved with the aid of the pole shoe pairs described above. In operation, a six-pole field is generated by the four pole shoes of the second and the third pair which are coupled to parts of the yoke ring facing each other and conveying opposite magnetic potentials. However, this is not a pure six-pole field because a dipole field component is inevitably also generated with four pole shoes (FIG. 9B). The invention is based on the recognition that coma errors can be corrected more effectively as this six-pole field is purer (that is to say, the fewer other field components, particularly dipole field components it comprises). The generation of a purer six-pole field is achieve within the scope of the invention by arranging the pole shoes of the first pair between the pole shoes of the second and the third pair. By providing these pole shoes with suitable (magnetic) potentials, a purer six-pole field can be generated than is possible with four pole shoes. In the ideal case, in operation, the pole shoes of the first pair have potentials whose signs are opposite to the potnetials of the pole shoes between which they are arranged (FIG. 9A). However, their constructive realization is complicated so that it will be preferred in many cases to magnetically couple the pole shoes in question to each other whereby they acquire the same potential (FIG. 9C). This solution can be optimized by having the magnetically coupled pole shoes extend more closely towards the electron gun than the pole shoes of the field distribution device (see FIG. 8).

In the case of a toroidally wound field deflection coil (FIGS. 1, 2) the flux pick-up legs having a structure as shown in FIG. 8 may be simply arranged along the sides of the yoke ring. In the case of a saddle-shaped field deflection coil with a flange at the gun-sided end, however, it is necessary, as is shown in FIG. 10, to form the gun-sided end 41 of the field deflection coil 42 in such a way that regions A and B of the gun-sided end 43 (the end face) of the yoke ring 44, which regions are located on either side of the symmetry plane of the line deflection coil (the x-z plane), are accessible. The regions where the magnetically permeable members 39 and 40 must pick up magnetic flux, A and B are denoted by arrows in FIG. 10. In other words, the inner sides of the saddle heads of the gun-sided field deflection coil end 41 must be sufficiently high to leave the gun-sided end 43 of the yoke ring 44 locally free. For the sake of clarity the line deflection coil has been omitted in FIG. 10. The line deflection coil must also make it possible to gain access to the region A and B of the gun-sided end 43 of the yoke ring 44, but generally it is not necessary to take special measures for this purpose. However, it must be ensured that the saddle heads of the gun-sided line deflection coil end leave open a sufficiently large region on either side of the y-z plane to pierce magnetically permeable member 39 and 40 of some height h (see FIG. 8) through the saddle heads and bring them in flux coupling relationship with (the inner surface of) the yokering 44. Finally it will be evident that also the support of the field deflection coil 42 (which support is not shown in the FIGS. ) must have apertures to provide access to the regions A and B of the yoke ring 43 with the magnetically permeable members 39 and 40.

Picking up flux of the yoke ring is of course not limited to the embodiments described above.

I claim:

1. A picture display system comprising a colour television display tube having a neck accommodating an electron gun assembly for generating three co-planar electron beams, and an electro-magnetic deflection unit surrounding the paths of the electron beams which have left the electron gun assembly, said deflection unit comprising a line deflection coil of the saddle type having a front and a rear end for deflecting electron beams generated in the display tube in a horizontal direction; a yoke ring of a ferro-magnetic material surrounding the line deflection coil and having front and rear end faces extending transversely to the tube axis; and a field deflection coil comprising two diametrically arranged halves and also having a front and rear end for deflecting electron beams generated in the display tube in a vertical direction, the electron beams generated by the electron gun assemably tranversing the coils of the deflection unit in the direction from the rear ends to the front ends, characterized in that a first pair of axially extending pole shoes of a magnetizable material is arranged in the said plane symmetrically with respect to the tube axis at the rear end of the deflection unit, substantially between the rear end and the electron gun assembly, which pole shoes are magnetically coupled to each other.

2. A picture display system as claimed in claim 1, characterized in that the pole shoes of the first pair are connected at their ends facing the electron gun assembly by means of an annular element of a magnetically conducting material surrounding the paths of the electron beams.

3. A picture display system as claimed in claim 1 or 2, characterized in that magnetically permeable means are added to the deflection unit, which means have an orientation and position for extending the vertical deflection field towards the electron gun.

4. A picture display system as claimed in claim 3, characterized in that the defelction unit comprises at its rear end second and third pairs of axially extending pole shoes which are oriented in accordance with the vertical deflection direction and which are arranged on the vertices of a square, the centre of the square being located on the tube axis and one pair of facing sides of the square being parallel to the vertical deflection direction, the second pair of pole shoes being magnetically coupled to a first side of the yoke ring and the third pair of pole shoes being magnetically coupled to the opposite side of the yoke ring, which sides have opposite magnetic potentials in operation, the one pole shoe of the first pair being present between the pole shoes of the second pair and the other pole

* * * * *